United States Patent [19]

Horstmann et al.

[11] 4,047,372

[45] Sept. 13, 1977

[54] PNEUMATIC THREADER FOR TWISTING APPARATUS

[75] Inventors: Aloys Horstmann, Greven; Reinhardt Veltel, Everswinkel, both of Germany

[73] Assignee: Hamel GmbH Zwirnmaschinen, Munster, Germany

[21] Appl. No.: 724,460

[22] Filed: Sept. 17, 1976

[30] Foreign Application Priority Data

Sept. 18, 1975 Germany ..... 2541690

[51] Int. Cl.[2] ..... D01H 13/04; D01H 13/12

[52] U.S. Cl. ..... 57/34 R; 57/106

[58] Field of Search ..... 57/1 R, 34 R, 34.5, 57/58.49, 58.7, 58.83, 58.86, 106

[56] References Cited

U.S. PATENT DOCUMENTS

| | | | |
|---|---|---|---|
| 1,962,265 | 6/1934 | Wenzel | 57/34.5 |
| 3,333,407 | 8/1967 | Bruin et al. | 57/106 X |
| 3,482,387 | 12/1969 | Slack | 57/106 |
| 3,605,396 | 9/1971 | Guignard et al. | 57/106 |
| 3,731,478 | 5/1973 | Franzen | 57/106 X |
| 3,975,893 | 8/1976 | Franzen | 57/106 X |

*Primary Examiner*—Donald Watkins
*Attorney, Agent, or Firm*—Karl F. Ross

[57] ABSTRACT

A pneumatic threader for a twisting apparatus has a nozzle formed with a counterbore so that the nozzle can be fitted over the end of the inlet tube of the twisting apparatus. In addition this nozzle is formed with a slot opening toward the tube and extending beyond the counterbore so that a filament engaged in this slot can freely pass into the tube. The slot may extend helically up around the tube so that automatic clamping of the filament is effected when it reaches the end of the helix. It is also possible to form the slot parallel to the air passage in the nozzle and to provide a clamping member for holding the filament end in the upper portion of this slot. To this end a lost-motion coupling may be provided between the valve-operating trigger of the pneumatic threading apparatus and the operating lever for opening of the clamp shortly after air flow has been started.

9 Claims, 4 Drawing Figures

FIG. 3
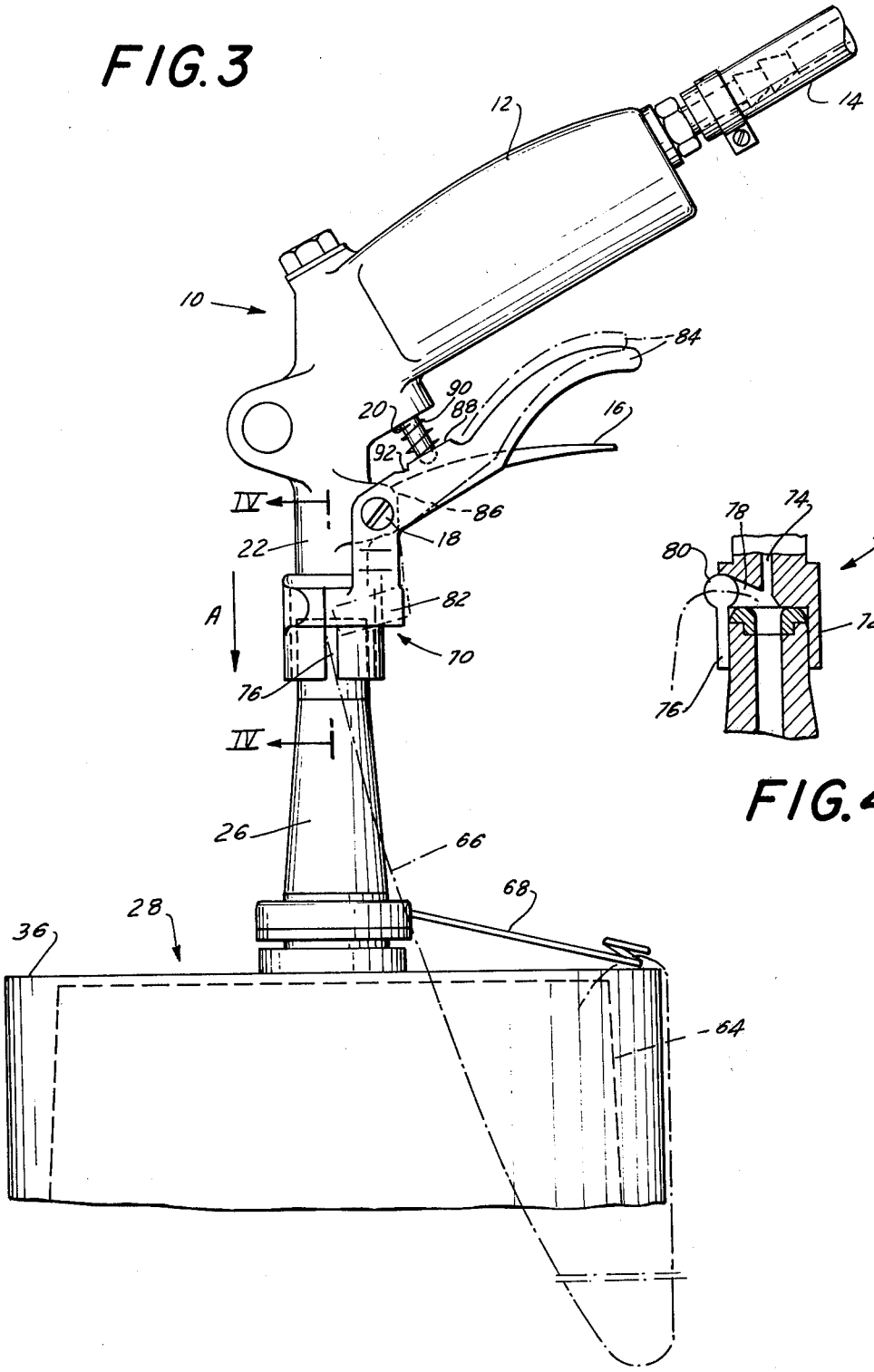
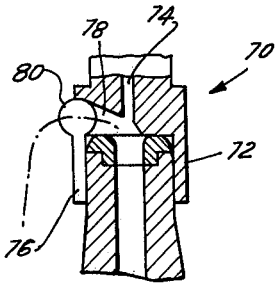
FIG. 4

PNEUMATIC THREADER FOR TWISTING APPARATUS

Cross-Reference to Related Applications

This application is related to the commonly assigned and copending patent applications Ser. Nos. 725,494, 724,462, and 724,461, filed Sept. 22, 1976, 17 Sept. 1976 and Sept. 17, 1976 respectively.

FIELD OF THE INVENTION

The present invention relates to a threading apparatus. More particularly this invention concerns a pneumatic threader for threading a filament through a twisting apparatus.

BACKGROUND OF THE INVENTION

In a twisting apparatus a yarn package or a plurality of yarn packages is mounted on a hollow spindle often provided with an internal thread brake. This spindle is normally rotatable with a flyer disk underlying the yarn packages. One or more yarns is pulled off the packages upwardly and is then passed downwardly through the hollow spindle, past the thread brake, and out a lateral hole in the rotating flyer. Thereafter the filament passes several times around the flyer reservoir disk and moves upwardly around the yarn packages forming a so-called balloon within an upwardly extending sleeve spaced laterally outwardly from the yarn packages. Thus each yarn or other filament must pass axially upwardly, radially inwardly, axially downwardly, radially outwardly, and axially upwardly again. (See German Offenlegungsschrift DT-OS No. 23 09 578.)

Obviously, threading a filament along such a complicated path is a complicated operation, and to this end pneumatic threaders have been employed. Normally these are simple blow guns of the standard commercially available type. The end of the filament is poked into the upper end of the inlet tube on the top of the twister, this tube is depressed as described in the above-cited application Ser. No. 725,494 in order to clear the passage through the inlet tube, and a blast of air is fired down the inlet tube. This air normally entrains the filament down along the relativey complicated path and even upwardly out of the annular upwardly open balloon gap.

There are three main problems with this system. Firstly, a common occurrence is that the filament gets pinched between the blow gun and the inlet tube so that it cannot flow freely. Secondly, this operation normally requires th operator to hold the blow gun in one hand and depress the inlet tube with the other so that the probability of of the yarn falling out of the inlet tube or of the operator blowing the yarn away from the inlet tube is considerable. Finally this system, when it works, is often so very powerful that several meters of the filament are blown up out of the balloon gap before the operator has time to release the trigger on the blow gun or grasp the filament. Thus this last-given disadvantage is particularly troublesome in systems where the twisters are arranged in banks, so that the loose filament can catch in other twisters and create a tangle that must be painstakingly removed.

OBJECTS OF THE INVENTION

It is therefore an object of the invention to provide an improved threading apparatus for a tube having an open filament-receiving end.

Another object is the provision of a threading apparatus which can readily be used with one hand.

Yet another object is to provide a threading apparatus wherein a great length of filament cannot inadvertently be blown through the thread passage of the twisting apparatus.

Still another object is to provide a threader of the pneumatic type which cannot accidentally pinch the yarn against the open tube end at least at the leading portion of the yarn.

SUMMARY OF THE INVENTION

These objects are attained according to the present invention in a threading apparatus having a nozzle formed with a passage and having a formation interfittable with the open end of the thread-receiving tube, with the passage directed into the open end.

According to this invention this nozzle is formed at the passage with the thread-receiving slot opening toward the tube. Means is connected to the passage for directing a stream of gas, normally compressed air, through the passage past the slot and into the open end of the tube when this open end is fitted to the formation on the nozzle. Thus a filament in the slot can be blown by the stream into the open end and thereafter the nozzle can be disengaged from the open end with the filament to slide out of the slot.

In accordance with another feature of this invention the slot extends helically. More particularly, in an arrangement with a yarn package fitted over the tube into which the filament is to be threaded the hand of the helical slot is the same as the hand with which the yarn is wound around the package. Thus, in accordance with a particularly advantageous feature of this invention, the filament can be fitted into the base of the helical slot. Then a blast of air will be able to displace only a length of filament corresponding to the circumference of the yarn package times the number of turns the yarn is displaced around the helical slot as it is pulled off the package. At the end of its travel the yarn becomes wedged between the helical slot and the top of the inlet tube and can no longer be displaced.

According to a further feature of this invention the nozzle is provided at the slot with a clamp that can hold the filament in the proper position across the passage in the nozzle at least until the threading operation is completed. This clamp may be formed by a clamping surface on the nozzle, a clamping element engageable with this surface so as to pinch a filament, and an operating element on the nozzle connected to the clamping elements. In an arrangement wherein the flow of air through the nozzle is controlled by an operating lever, this operating lever and the operating element for the clamp may be iterconnected for simultaneous releasing of the filament and starting of the air blast.

More particularly in accordance with this invention, when the device is to be used with a relatively heavy yarn, the worker may clamp the end of the yarn in the tip of the tool, then this tip is fitted over the upper end of the inlet tube of the twisting apparatus and the air-release lever is actuated. Shortly after actuation of the air-release lever, through a lost-motion coupling with the operating element of the clamping element, this clamping element is pulled away from the clamping surface so as to release the yarn and allow it to be blown pneumatically through the twisting apparatus. All of this may be done with one hand while the operator holds a loop of yarn in the other hand to prevent it from twisting up.

According to further features of this invention the formation at the tip of the nozzle is a counterbore between 1 mm and 2 mm deep and dimensioned to fit snugly over the upper end of the tube. The slot extends substantially further into the nozzle than the counterbore so that the filament cannot be pinched between the base of this slot and the mouth of the tube.

With the system according to the present invention it is therefore possible rapidly and easily to thread even multiple-strand yarn through a twisting apparatus. The helical slot usable with particularly fine filaments insures that too much of the filament will not be blown through, as the operator can readily determine the amount of filament to be blown through by the placement of the tip of the filament at th appropriate location in the helical slot. With the clamping arrangement provided in the slot it is possible for the operator in one-hand fashion to carry out all of the necessary steps for threading the device while holding the yarn under appropriate light tension in the other hand. When the clamping arrangement is used it is only necessary to provide a slot which extends parallel to the direction of flow of the air in the passage, not helically. It is noted, however, that it is perfectly possible to provide the clamping arrangement on the threader with a helical slot, it merely being necessary to clamp the filament at a widened portion of the nozzle tip at the base of the helical slot.

BRIEF DESCRIPTION OF THE DRAWING

The above and oher objects, features and advantages of the invention will become more readily apparent from the following description, reference being made to the accompanying drawing in which:

FIG. 3 is a view similar to FIG. 1 showing another threading apparatus in accordance with the present invention; and FIG. 4 is a section taken along line IV—IV of FIG. 3.

SPECIFIC DESCRIPTION

Figure 1:
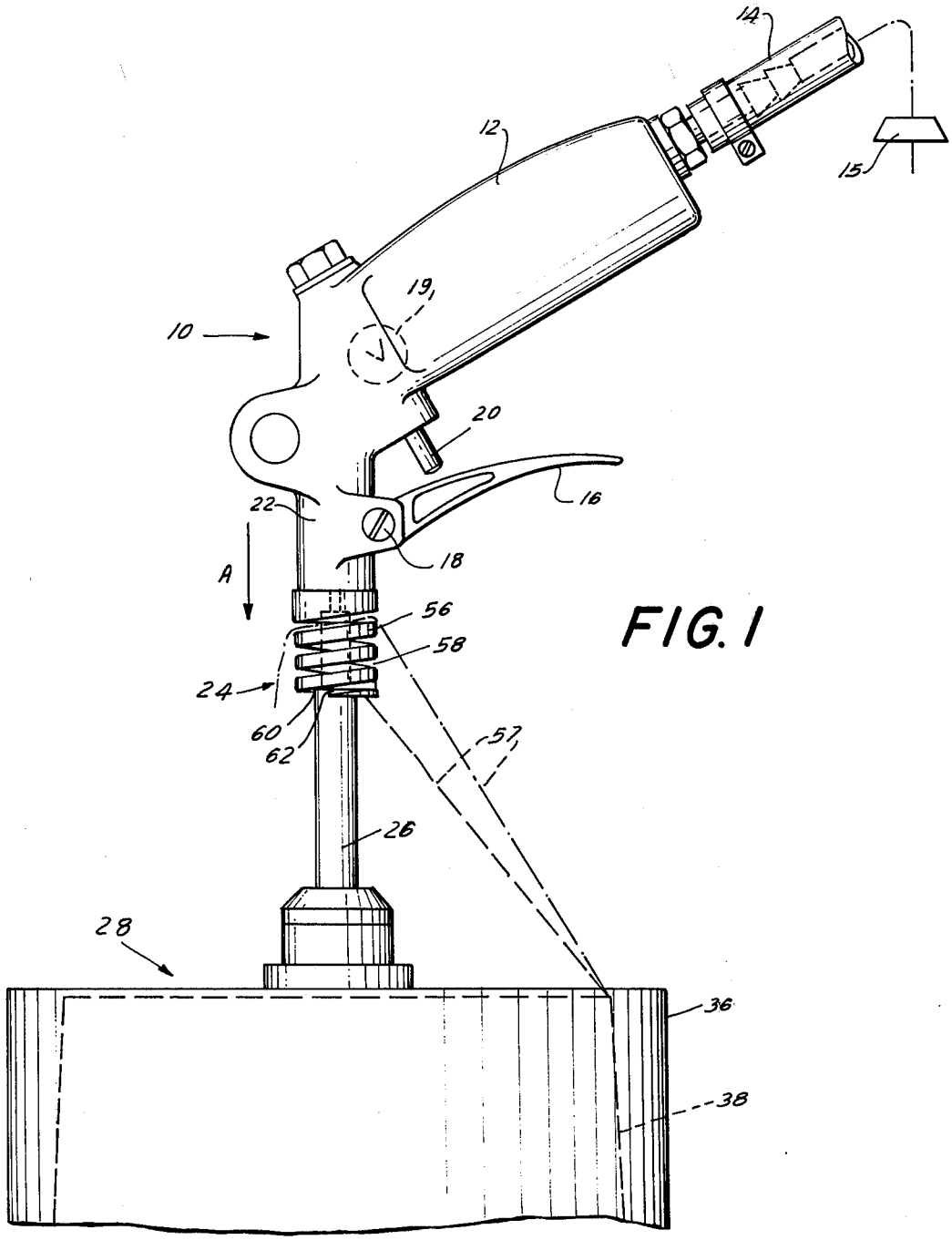
FIG. 1 is a side partly diagrammatic view illustrating the threading apparatus according to the present invention.
Figure 2:
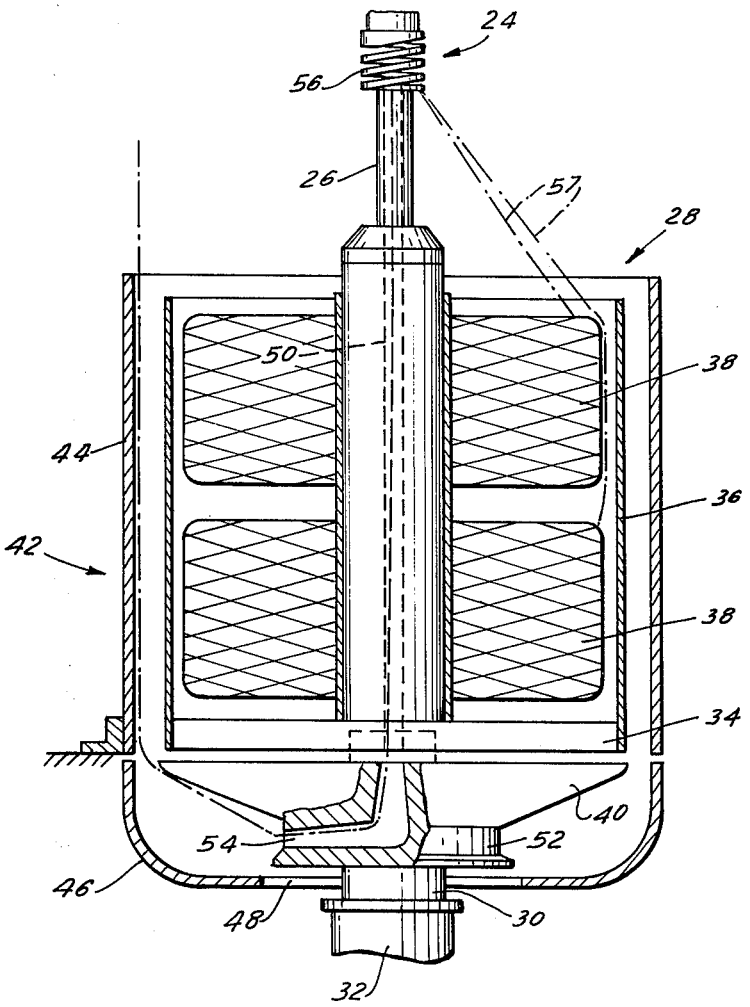
FIG. 2 is a vertical section taken through the twister and tip of the threading yarn of FIG. 1.

The arrangement shown in FIGS. 1 and 2 has a pistol grip housing 10 with a handle 12 from which extends a hose 14 connected to the output of an air compressor 15. An operating lever 16 is pivoted at 18 on the nozzle part 22 of the device 10 and is engageable with a pin 20 connected to an internal valve 19 that allows air to flow from the compressor 15 into the passage of the nozzle part 22 shown at 74 in FIG. 4.

Removably screwed onto the male threaded end of the nozzle part 22 is a tip 24 that is engageable over the inlet tube 26 of a twisting apparatus 28 as shown in detail in FIG. 2.

The tube 26 of FIG. 1 is of cylindrical shape and has an upper end 62 fittable in a counterbore 60 between 1 mm and 2 mm deep. In addition this tip is formed of a helical member 56 so as to define a helical slot 58 here of 3.5 turns.

As is best seen from FIG. 2 the twisting apparatus 28 rests on a hollow shaft 30 having a whorl 32 normally engaged by a flat belt so as rotationally to drive this shaft 30 and to drive a flyer-storage disk 40 carried thereon. Rotatable on this shaft 30 is a yarn-package support 34 having an outer sleeve 36 and carrying a pair of yarn packages 38 from which filaments 57 are pulled. The inlet tube 26 is formed with a longitudinally through going passage 50 that opens at its lower end into the vertically upwardly opening leg of an L-shaped passage 54 formed in the flyer disk 40 and opening at the lower cylindrical portion 52 thereof. In addition a non-rotatable outer balloon-limiting cup 42 formed of a cylindrical upper part 44 and a dished lower part 46 having a hole 48 through which extends the shaft 30 is provided outside the sleeve 36 and separated therefrom by a gap. This balloon limiter 42 is nonrotatable and fixedly mounted. Magnets carried on the support 34 and the balloon limiter 42 attract each other so as normally to prevent rotattion of the yarn packages 38. Thus only the flyer disk and its potion 52 rotate.

Normally the two yarns 57 pass directly upwardly between the packages 38 and the sleeve 36, then pass downwardly through the passage 50, outwardly through the passage 54, and upwardly again between the sleeves 36 and 44. Since the flyer disk 40 is rotating at extremely high speed and a thread brake is provided in the passage 50, the two filaments 57 are wound together tightly so as to form a 2-ply twisted thread.

The apparatus shown in FIGS. 1 and 2 is used by first fitting its tip 24, or more accurately its counterbore 60, over the upper end 62 of the tube 26 and then displacing this tube 26 downwardly in the direction of arrow A in order to move the thread brake in the passage 50 laterally to the side and open up this passage 50. Then the leading ends of the two filaments 57 are placed in the uppermost end of the helical slot 58.

The operator then depresses the lever or trigger 16 toward the handle 12 so as to open the valve 19 and fire a blast of air down through the inlet tube 26. This stream of air will entrain the filaments 57 so as to pull several turns of these filaments off the packages 38. The filaments 57 are wound around the packages 38 with the same hand as the helical slot 58. Thus after unwinding three and one half turns these filaments 57 will have moved from the upper dot-dash line position of FIG. 1 to the lower dashed line position so that they will become pinched between the last turn of the helix 56 and the upper edge 62 of the tube 26. At this point the current of air will not be able to pull them any further so that filament advance will stop, even if the trigger 16 is held up.

Thus in an arrangement wherein yarn packages having a diameter of approximately 100 mm are used it is possible to place the tips of these yarns in the end of the third turn of the helical slot 58 and only pull off 940 mm of the filament. This not only prevents wasting the yarn, but also prevents the free end of the yarn which has been blown up between the sleeves 36 and 44 from tangling in adjoining devices.

In the arrangement of FIGS. 3 and 4 the structure identical to that of FIGS. 1 and 2 is referenced with the same numerals.

Here, however, the device is used with a yarn package 64 of relatively heavy yarn that must pass through a traveler eye 68 of the twisting apparatus 26. Thus it is necessary to form a relatively large loop 66 and normally the current of air produced by the compressor 15

(FIG. 1) is insufficiently strong to pull the yarn off the package 64 and through the flyer eye 68.

To this end a tip 70 is mounted on the end of the nozzle part 22. This tip 70 has a counterbored portion 72 snugly engageable over the upper end of the inlet tube 26 for alignment of the passage 74 with the interior of the tube 26. In addition this tup 70 is formed with an axially extending slot 76 which terminates well above the counterbored potion 72 so as to form a passage 78 opening into the passage 74.

The tip 70 is formed at one side of the slot 76 with a widened clamping surface 80 against which is engageable a clamping lement 82 unitarily formed with a U-section handle 84 flanking the trigger 16 but lying between this trigger 16 and the pistol grip 12. This U-shaped lever 84 is provided with a bridge 88 through which passes the pin 20. A compression spring 90 bears between the handle part 12 and the bridge 88 and normally biases this element 84 away from the handle 12 while simultaneously pressing the clamping element 82 against the surface 80. Furthermore the pin 18 which passes through a lug 86 on the nozzle part 22, also passes through the cheeks of the U-section element 84 so that this arrangement 82, 84 can be mounted on a conventional blow gun. The trigger 16 is engageable with a potion 92 of the bridge 88.

With this device it is essential that the operator prevent the often freshly twisted yarn and the tangle-prone yarns of the package 64 from winding together. Thus the tip of the yarn is clamped between the elements 80 and 82 by actuation only of the lever 84 which can readily be moved by slipping the fingers of the hand holding the grip 12 between the lever 84 and the trigger 16. Since the clamp is spring loaded the filament end will automatically be held against the surface 80.

The tip 70 is then fitted over the upper end of the inlet tube 26 and is pressed downwardly in the direction of arrow A so as to open up the thread passage of the twister. Thereupon the trigger 16 is actuated so as to start the air flow through the passage 74 and into the tube 26. After a short portion of the travel of the trigger 16 toward the handle 12 it will engage the portion 92 of the bridge 88 of the handle 84 and pull the clamping member 82 automatically away from the surface 80 and allow the tip of the filament to be blown down the tube 26 so as to entrain the entire loop 66.

All of these above-mentioned operations can readily be carried out with one hand so that the operator has his or her other hand free to hold the filament in the loop 66 under slight tension and prevent it from becomeing tangled. Once the feeding has started the operator can readily allow the filament to move into the upper open end of the slot 76 until the desired length of filament has been threaded through the twister 28.

With the systems according to the present invention it is therefore possible rapidly and easily to thread a twisting apparauts. The threader can be used with one hand an allows the operator to do the threading operation with such a speed that the normally considerable proportion of time needed for reloading a twisting apparatus is reduced to a minimum.

We claim:

1. In combination with a tube having an open filament-receiving end, a threading apparatus comprising:
   a nozzle formed with a passage and having a formation interfittable with said open end with said passage directed into said open end, said nozzle being formed at said passage with a thread-receiving slot opening toward said tube; and
   means for directing a stream of gas through said passage past said slot and into said open end when same is fitted to said formation, whereby a filament in said slot can be blown by said stream into said open end and thereafter said nozzle can be disengaged from said open end with said filament sliding out of said slot, said slot extending helically in said nozzle past said formation.

2. The combination defined in claim 1 wherein said tube is constructed and adapted to support at least one yarn package on which yarn is wound with a predetermined hand, said helical slot extending with the same hand. said slot extending helically in said nozzle past said formation.

3. In combination with a tube having an open filament-receiving end, a threading apparatus comprising:
   a nozzle formed with a passage and having a formation interfittable with said open end with said passage directed into said open end, said nozzle being formed at said passage with a thread-receiving slot opening toward said tube; and
   means for directing a stream of gas through said passage past said slot and into said open end when same is fitted to said formation, whereby a filament in said slot can be blown by said stream into said open end and thereafter said nozzle can be disengaged from said open end with said filament sliding out of said slot, said formation being a counterbore sunk in the end of said nozzle.

4. In combination with a tube having an open filament-receiving end, a threading apparatus comprising:
   a nozzle formed with a passage and having a formation interfittable with said open end with said passage directed into said open end, said nozzle being formed at said passage with a thread-receiving slot opening toward said tube;
   means for directing a stream of gas through said passage past said slot and into said open end when same is fitted to said formation, whereby a filament in said slot can be blown by said stream into said open end and thereafter said nozzle can be disengaged from said open end with said filament sliding out of said slot; and
   means for temporarily clamping said filament in said slot.

5. The combination defined in claim 4 wherein said means for directing said stream of gas includes a valve connected to said passage and an operating lever pivoted on said nozzle and operatively connected to said valve.

6. The combination defind in claim 5 wherein said means for clamping includes an operating element engageable with said operating lever, a clamping surface on said nozzle, and a clamping element engageable with said surface and rigid with said operating element.

7. The combination defined in claim 6 wherein said clamping element is integral with said operating element.

8. The combination defined in claim 7 wherein said operating lever is displaceable through a predetermined travel in a predetermined direction toward said operating element for actuation of said valve, said operating element being engaged by said operating lever only after same has traveled in said direction through a portion of said travel.

9. The combination defined in claim 7 wherein said operating lever and said operating member are jointly pivoted on said nozzle for pivoting about a common axis, said means for clamping including at least one spring braced between said nozzle and said operating element and lever biasing both of same away from said nozzle.

* * * * *